US005083662A

United States Patent [19]

Bishop et al.

[11] Patent Number: 5,083,662

[45] Date of Patent: Jan. 28, 1992

[54] KEY COVER

[75] Inventors: Thomas R. Bishop, Spring Lake; Richard A. Thom, Muskegon, both of Mich.

[73] Assignee: Pliant Plastics Corporation, Muskegon, Mich.

[21] Appl. No.: 667,809

[22] Filed: Mar. 12, 1991

[51] Int. Cl.[5] ..... E05B 19/04

[52] U.S. Cl. ..... 206/37.1; 70/456 R; 70/408; 206/37.3

[58] Field of Search ..... 70/456 R, 408; 206/37.1, 37.3

[56] References Cited

U.S. PATENT DOCUMENTS

| | | | |
|---|---|---|---|
| 3,349,589 | 10/1967 | Fricke | 70/408 X |
| 3,841,120 | 10/1974 | Gartner | 70/408 X |
| 4,102,166 | 7/1978 | Hughes | 70/408 X |
| 4,305,267 | 12/1981 | Nish et al. | 70/408 X |
| 4,403,487 | 9/1983 | Marty | 70/408 |
| 4,472,954 | 9/1984 | Kichise | 70/408 |
| 4,768,362 | 9/1988 | Schmalz, Jr. | 70/408 |

FOREIGN PATENT DOCUMENTS

| | | | |
|---|---|---|---|
| 2634634 | 2/1990 | France | 206/37.1 |
| 2218463 | 11/1989 | United Kingdom | 70/456 R |

*Primary Examiner*—William I. Price

*Attorney, Agent, or Firm*—Varnum, Riddering, Schmidt & Howlett

[57] ABSTRACT

This relates to a key cover for covering the head of a key. The key cover is formed in two pieces, a cover member and a plug. The cover member is provided with a cavity for receiving the key head with the blade of the key passing through a slot in the underside of the cover member. A plug is then readily insertable into the top of a cavity in overlying relation to the key head disposed within the cavity of the cover member and locked in place with the cover member. The interlock between the plug and the cover member is one wherein the plug cannot be readily removed unless the cover, for all practical purposes, is locked in place on the key. This permits the key cover to be individually applied to a key without materially disassociating the key from its respective lock.

14 Claims, 2 Drawing Sheets

KEY COVER

BACKGROUND OF THE INVENTION

1. Field of the Invention.

This invention relates in general to new and useful improvements in covers for keys, and more particularly to a key cover which includes a cover member for receiving therethrough a key with the head of a key being retained within the cover member, and there being a plug insertable into the cover member after the key has been positioned therein to lock the head of the key firmly within the cover member.

2. Scope of the Prior Art.

It is known to provide covers for keys. Key covers in the past come basically in two forms: (1) integrally molded around the key; and (2) multipart covers which are fabricated around the key. The molded covers are formed by placing a key head in a mold and injecting a polymer into the mold to encapsulate the key head. After the polymer is cured, the key with the integrally molded cover is removed. One of the principal disadvantages afforded by this process is that a tracking system must be maintained to ensure that each key can be relocated with its corresponding lock. Otherwise, the locks have to be rekeyed after the keys are covered. In addition, alignment of keys in the mold is critical, and such alignment is typically done manually. Further, most keys are stamped and there are some inherent difficulties in molding polymers around stamped metal parts. Overall, the process is quite expensive and adds significantly to the cost of the key and lock system. The fabricated covers typically comprise two premolded halves, each half having a recessed area to receive the key head. When the key head is placed in the recessed area, the two halves are attached to envelop the key head and provide a cover. The two halves are typically attached by gluing. Again, the key cover is not installable in the field, and thus requires that the key be separated from its corresponding lock. Further, gluing parts together has inherent disadvantages requiring additional materials, time and labor to fabricate the cover. In addition, such covers have a tendency to come apart in the field with use.

SUMMARY OF THE INVENTION

The invention particularly relates to a premolded key cover member with a cavity to receive the key head. A slot extending from the cavity through one end of the cover member is adapted to receive the blade and the key. The other end of the cover member has a wider slot so that the key is received within the cover member blade first, and the head of the key rests within the cavity with the blade extending through the slot external of the cover member. A separate insert in the form of a plug is then received within the wide slot to plug the open end of the cover member and bear against the edge of the key head to hold the key head securely within the cavity. A tab on at least one side of the plug snaps into a premolded detent in the cover member to securely retain the plug in the end of the cover member. The plug is flush with the cover member so that it effectively cannot be removed without destroying the cover member or the insert.

With the above and other objects in view that will hereinafter appear, the nature of the invention will be more clearly understood by reference to the following detailed description, the appended claims, and the several views illustrated in the accompanying drawing.

DETAILED DESCRIPTION OF THE DRAWINGS

Figure 7:
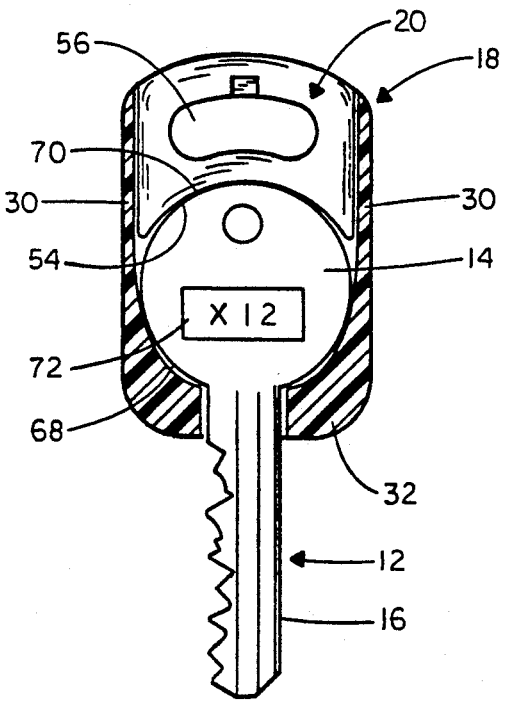
FIG. 7 is a vertical sectional view taken through the entire key cover with a typical key inserted within the cover member and retained in place by the plug, the view being similar to FIG. 4.

Referring now to the drawings in detail, with reference to FIG. 7, it will be seen that there is illustrated a key cover 10 which is constructed to receive on site a key, generally identified by the numeral 12 which includes a head 14, sometimes also known as a "bow", and a blade 16.

The key cover 10 is formed in two parts, a cover member generally identified by the numeral 18 and an insert or plug generally identified by the numeral 20.

Figure 1:
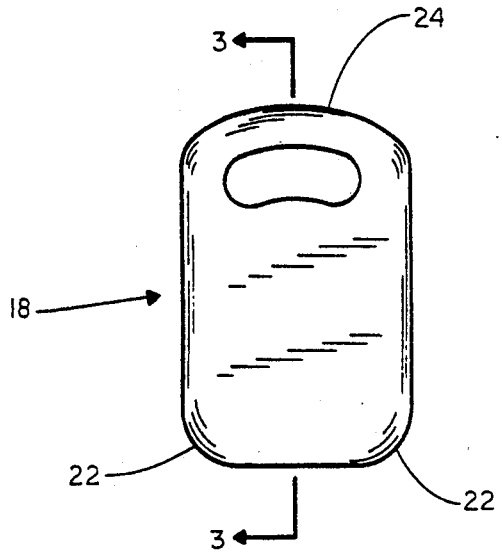
FIG. 1 is a side elevational view of a cover member formed in accordance with this invention.
Figure 2:
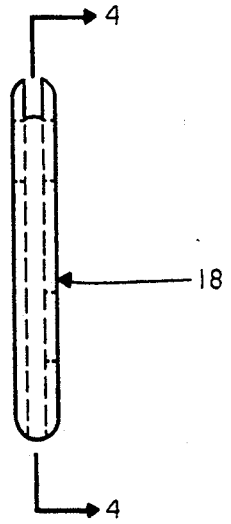
FIG. 2 is an end elevational view of the cover member of FIG. 1 taken from the right side thereof.

The cover member 18, which is best illustrated in FIGS. 1 through 4, is of a generally rectangular outline and, as best shown in FIG. 1, is provided with lower corners 22 and a curved top wall 24. Although the preferred embodiment is illustrated, it will be understood that the cover member 18 can take any shape commensurate with the dimensions of the key head 14 and aesthetic requirements.

Figure 3:
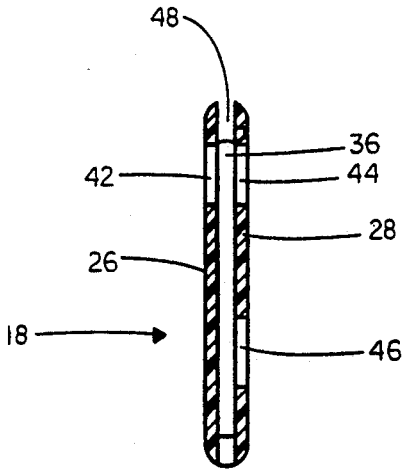
FIG. 3 is a vertical sectional view through the cover member taken generally along the line 3—3 of FIG. 1 and shows the general cross section thereof.
Figure 4:
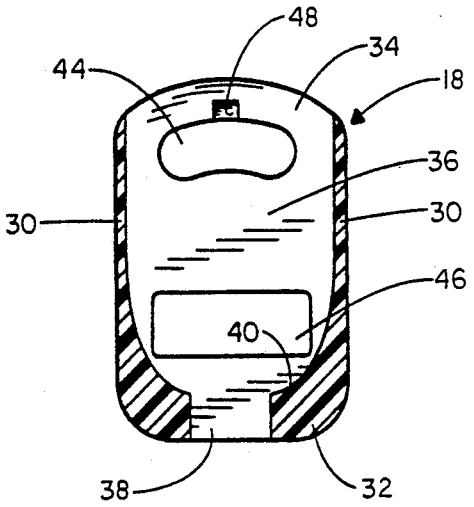
FIG. 4 is a vertical sectional view taken generally along the line 4—4 of FIG. 2 and shows the general outline of the cavity formed in the cover member.

The cover member 18 is of a molded plastic material construction and includes opposite side walls 26, 28 (FIG. 3) joined together by ends 30 (FIG. 4). Further, as is also best shown in FIG. 4, the cover member 18 has a relatively thick bottom 32 and an open top 34.

It will be seen that the walls of the cover member 18 define an internal cavity 36. The cavity 36 extends through the open top 34 and is provided with a continuation in the form of a central slot 38 through the bottom wall 32. The slot 38 is of a size to receive a blade of a key as will be described in more detail hereinafter.

Also, the top surface of the bottom wall 32 is configurated as at 40 to generally match the configuration of the lower edge of a key head as will also be described in detail hereinafter.

It is also to be noted from FIG. 3 that the cavity 36 tapers in thickness from the top to the bottom so as to both facilitate the insertion of a key into the cover member 18 and also to have the lower portion of a key head snugly fit between the walls 26, 28.

As is best shown in FIGS. 1, 3 and 4, the walls 26, 28 are provided with transversely aligned openings 42, 44 for receiving a key retainer, such as a key ring or chain (not shown). The side wall 28 is also provided with an opening 46 intended to be aligned with key identifying indicia on the head of a key.

Finally, the interior of each of the walls 26, 28 is provided immediately above a respective one of the openings 42, 44 with molded notches 48 which are of a tapered configuration as shown in FIG. 3 to form detents.

Figure 5:
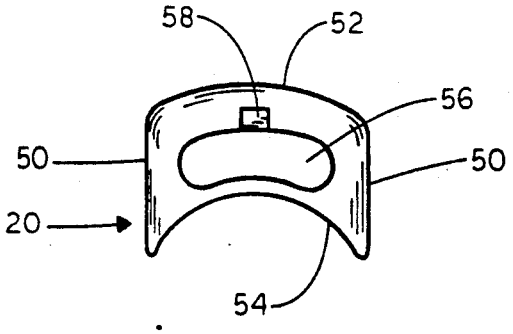
FIG. 5 is a front elevational view of an insert or plug for retaining a key head in the cavity of the cover member.
Figure 6:
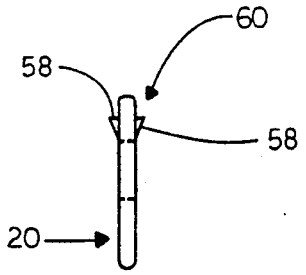
FIG. 6 is a side elevational view of the plug FIG. 5.

Referring now to FIGS. 5 and 6, it will be seen that the plug 20 is also of a generally rectangular outline including parallel sides 50. The plug 20 has an arcuate top wall 52 which matches the shape of the top wall 24 of the cover member 18 and a recessed arcuate bottom wall 54 which will match the contour of the upper edge of the intended key head.

The plug 20, as shown in FIG. 6, is of a constant thickness although it may be tapered in thickness to match the taper of the cavity 36.

The plug 20 is provided with an opening 56 therethrough which matches the outline and location of the openings 42, 44 so as to be aligned therewith when the plug 20 is in place within the cover member 18.

Finally, the plug 20 is provided on opposite faces thereof with projecting tabs 58 which increase in thickness upwardly so as to define retaining shoulders 60. When the plug 20 is inserted into the cavity 36, the tabs 58 align with the recesses 48 and when the plug 20 is fully inserted within the cavity 36, the shoulders 60 snap into the notches 48 and lock the plug in place.

Because the configuration of the plug matches that of the upper part of the cover member 18, once the plug 20 is locked in place, it cannot be readily removed.

It is to be understood that the configuration of the cavity 36 and the underside of the plug 20 will be varied depending upon the specific key head configuration. The typical key, generally identified by the numeral 12, is illustrated within the key cover 10 in FIG. 7. The key 12 will include a head 14 and a blade 16 in the customary manner. The head 14 will have a configurated under surface 68 and a configurated top surface 70. The surface 40 at the bottom of the cavity 36 will correspond to the configuration of the surface 68 while the configuration of the surface 54 on the underside of the plug 28 will correspond to the top surface 70 of the head 14.

The key head 14 may also be provided with an identification panel 72. When the key 12 is mounted within the cover 10, the identification panel 72 will be aligned with the opening 46.

Referring now specifically to FIG. 7, it will be seen that in order to apply the cover 10 to the key 12, it is merely necessary to insert the key 12 into the cover member 18 through the open top with the blade 16 passing through the slot 38. The key 12 is pushed into the cover member 18 until the key head 14 seats on the surface 40 at the bottom of the cavity 36. Then the plug 20 is inserted into the cavity 36 through the open top 34 of the cover member 18 until the projecting tabs 58 snap into the notches 48. The shoulders 60 thus effectively prevent removal of the plug 20. The relationship of the size and the configuration of the key head 14 with respect to the cavity 36, the surface 40, and the under surface 54 of the plug 20 should be one wherein when the plug 20 is fully inserted into the cavity and locked in place, the key head 14 will be clamped between the plug 20 and the surface 40 as is clearly shown in FIG. 7.

It will be readily apparent that when the key cover 10 is specifically configurated to receive a particular key configuration, all that is required to apply the key cover 10 to the key 12, for example, is to move the key 12 into the cover member 18 and then seat the plug 20 within the upper part of the cavity 36 and lock the plug 20 in place. No molding over the key and no gluing is in any way required. All that is necessary is to make certain that the face of the key head 14, bearing the identification panel 72, opposes the side wall 28 so as to be aligned with the opening 46.

It is to be understood that the cover member 18 may provide the faces of the side walls 26, 28 with any decorative design and may also include advertising indicia none of which has been specifically illustrated. Thus when an automobile dealer, for example, wishes to provide keys of automobiles being sold with specific covers, such as the cover 10, the covers may be rapidly installed key by key without the key being disassociated from the respective lock.

Although only a preferred embodiment of the key cover has been specifically illustrated and described herein, it is to be understood that minor variations may be made in the key cover without departing from the spirit and scope of the invention as defined by the appended claims.

The embodiments of the invention in which on exclusive property or privilege is claimed are defined as follows:

1. A key cover for a key of the type including an elongated blade and a wider head, said key cover comprising a cover member having opposing walls defining in part a cavity for receiving a key head, one of said walls having a shoulder notch, said cover member further having an opening through one end thereof to the cavity, and a slot through an opposite end thereof to the cavity for receiving a key blade, and a plug receivable in said opening at said one end, said plug having remote faces and a projecting tab on at least one of said faces for engaging the shoulder notch to secure the plug in the opening.

2. A key cover according to claim 1 wherein said opposite end is of an axial extent and defines an end of said cavity of a configuration generally matching an outline of an intended key head adjacent its blade.

3. A key cover according to claim 1 wherein said plug has a lower edge profile generally matching an outline of an upper edge of a head of an intended key.

4. A key cover according to claim 1 wherein said cavity tapers in transverse depth from said one end towards said opposite end.

5. A key cover according to claim 1 wherein said cover member has walls separated by said cavity, and at least one of said walls has a key identification receiving opening therein.

6. A key cover according to claim 1 wherein both said cover member and said plug are of a molded plastic construction.

7. A key cover according to claim 1 wherein said cover member and said plug have aligned matching upper edges.

8. A key cover according to claim 1 wherein said cover member and said plug have aligned openings for receiving a key retainer.

9. A key cover according to claim 8 wherein said opposite end is of an axial extent and defines an end of said cavity of a configuration generally matching an outline of an intended key head adjacent its blade.

10. A key cover according to claim 9 wherein said plug has a lower edge profile generally matching an outline of an upper edge of a head of an intended key.

11. A key cover according to claim 10 wherein said cavity tapers in transverse depth from said one end towards said opposite end.

12. A key cover according to claim 11 wherein said cover member has walls separated by said cavity, and at least one of said walls having a key identification receiving opening therein.

13. A key cover according to claim 12 wherein both said cover member and said plug are of a molded plastic construction.

14. A key cover according to claim 13 wherein said cover member and said plug have aligned matching upper edges.

* * * * *